US010408231B2

(12) United States Patent
Veitch et al.

(10) Patent No.: US 10,408,231 B2
(45) Date of Patent: Sep. 10, 2019

(54) ROTOR WITH NON-UNIFORM BLADE TIP CLEARANCE

(71) Applicant: PRATT & WHITNEY CANADA CORP., Longueuil (CA)

(72) Inventors: Thomas Veitch, Scarborough (CA); Farid Abrari, Mississauga (CA); Ernest Adique, Brampton (CA); Daniel Fudge, Vaughan (CA); Kari Heikurinen, Oakville (CA); Paul Stone, Guelph (CA); Ignatius Theratil, Mississauga (CA); Peter Townsend, Mississauga (CA); Tibor Urac, Mississauga (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 163 days.

(21) Appl. No.: 15/703,472

(22) Filed: Sep. 13, 2017

(65) Prior Publication Data

US 2019/0078589 A1 Mar. 14, 2019

(51) Int. Cl.

| | |
|---|---|
| ***F01D 5/14*** | (2006.01) |
| ***F04D 29/66*** | (2006.01) |
| ***F04D 29/32*** | (2006.01) |
| ***F01D 5/16*** | (2006.01) |

(52) U.S. Cl.

CPC ..... *F04D 29/666* (2013.01); *F01D 5/16* (2013.01); *F04D 29/324* (2013.01); *F04D 29/327* (2013.01); *F04D 29/668* (2013.01); *F05D 2220/36* (2013.01); *F05D 2240/307* (2013.01); *F05D 2260/961* (2013.01)

(58) Field of Classification Search

CPC ..... F01D 5/16; F04D 29/324; F04D 29/327; F04D 29/666; F04D 29/668; F05D 2220/36; F05D 2240/307; F05D 2260/961

USPC ..... 416/203

See application file for complete search history.

(56) References Cited

U.S. PATENT DOCUMENTS

| | | | | |
|---|---|---|---|---|
| 4,878,810 | A | 11/1989 | Evans | |
| 5,286,168 | A | 2/1994 | Smith | |
| 6,042,338 | A | 3/2000 | Brafford et al. | |
| 6,428,278 | B1 | 8/2002 | Montgomery et al. | |
| 8,043,063 | B2 * | 10/2011 | Kelly | F01D 5/10 415/119 |

(Continued)

FOREIGN PATENT DOCUMENTS

| | | |
|---|---|---|
| EP | 1211383 | 6/2002 |
| EP | 1746249 | 1/2007 |

OTHER PUBLICATIONS

European Search Report of Application No. 18194363.0 dated Feb. 20, 2019.

*Primary Examiner* — Erick R Solis

(74) *Attorney, Agent, or Firm* — Norton Rose Fulbright Canada LLP

(57) ABSTRACT

A rotor for a gas turbine engine comprises a rotor having a hub and blades around the hub, and extending from the hub to tips. The tips include first and second tip portions between their respective tip leading edge and tip trailing edge. Tips are spaced from a rotational axis of the rotor by spans. A mean span of a first tip portion of a first blade is greater than a mean span of a corresponding first tip portion of a second blade. A mean span of a second tip portion the first blade is less than a mean span of a corresponding second tip portion of the second blade.

20 Claims, 3 Drawing Sheets

(56) References Cited

U.S. PATENT DOCUMENTS

| | | | | |
|---|---|---|---|---|
| 8,888,459 | B2 * | 11/2014 | Noble | F01D 5/22 416/193 A |
| 9,382,916 | B2 | 7/2016 | Schoenenborn | |
| 9,657,581 | B2 * | 5/2017 | Woehler | F01D 5/26 |
| 9,932,840 | B2 * | 4/2018 | Fulayter | F01D 5/26 |
| 10,215,194 | B2 * | 2/2019 | Theratil | F04D 29/666 |
| 2008/0134504 | A1 | 6/2008 | Schoenenborn | |
| 2015/0139789 | A1 | 5/2015 | Schoenenborn | |
| 2016/0290137 | A1 * | 10/2016 | Li | F04D 29/324 |
| 2017/0241432 | A1 * | 8/2017 | Theratil | F02K 3/06 |

* cited by examiner

ROTOR WITH NON-UNIFORM BLADE TIP CLEARANCE

TECHNICAL FIELD

The application relates generally to rotating airfoils for gas turbine engines, and more particularly to mistuned rotors.

BACKGROUND

Aerodynamic instabilities, such as but not limited to flutter, can occur in a gas turbine engine when two or more adjacent blades of a rotor of the engine, such as the fan, vibrate at a frequency close to their natural frequency and the interaction between adjacent blades maintains and/or strengthens such vibration. Other types of aerodynamic instability, such as resonant response, may also occur and are undesirable. Prolonged operation of a rotor undergoing such aerodynamic instabilities can produce a potentially undesirable result caused by airfoil stress load levels exceeding threshold values. Attempts have been made to mechanically or structurally mistune adjacent blades of such rotors, so as to separate their natural frequencies.

SUMMARY

There is accordingly provided a rotor for a gas turbine engine, the rotor adapted to be received within a casing having a radially inner surface and configured for rotation about a rotational axis, the rotor comprising a hub and blades circumferentially distributed around the hub, the blades extending radially along spans from the hub to tips thereof and including at least first blades and second blades, the blades having airfoils with leading edges and trailing edges, the tips of the blades extending axially relative to the rotational axis of the rotor from tip leading edges to tip trailing edges, the tips of each of the blades having at least first and second tip portions extending axially between the tip leading edges and the tip trailing edges; wherein a mean span of the first tip portion of the first blades is greater than a mean span of the corresponding first tip portion of the second blades, and a mean span of the second tip portion of the first blades is less than a mean span of the corresponding second tip portion of the second blades.

There is also provided a gas turbine engine comprising: a rotor having a hub and a plurality of blades circumferentially distributed around the hub, the blades extending radially from the hub to tips of the blades, the blades having airfoils with leading edges and trailing edges, the tips of the blades extending axially relative to a rotational axis of the rotor from tip leading edges to tip trailing edges, the tips of the blades having at least first and second tip portions extending between the tip leading edges and the tip trailing edges; and a casing disposed around the rotor, a radially-inner surface of the casing spaced from the tips of the blades by radial tip clearances; wherein a mean radial tip clearance of a first tip portion of one of the blades is greater than a mean radial tip clearance of a first tip portion of another one of the blades, and a mean radial tip clearance of a second tip portion the one of the blades is less than a mean radial tip clearance of a second tip portion of the other one of the blades.

There is further provided a method of forming a rotor within a casing of a gas turbine engine, the method comprising: providing the rotor with a hub and a plurality of blades circumferentially distributed around the hub, the blades extending radially from the hub to tips of the blades and including at least first and second blades, the tips of the blades adapted to be circumscribed by the casing; forming a first radial tip clearance gap between a first tip portion of the first blades and a layer of abradable material on an inner surface of the casing; and forming a second radial tip clearance gap between a second tip portion of the second blades and the layer of abradable material, the first and second radial tip clearance gaps being different.

BRIEF DESCRIPTION OF THE DRAWINGS

Reference is now made to the accompanying figures in which.

DETAILED DESCRIPTION

Figure 1:
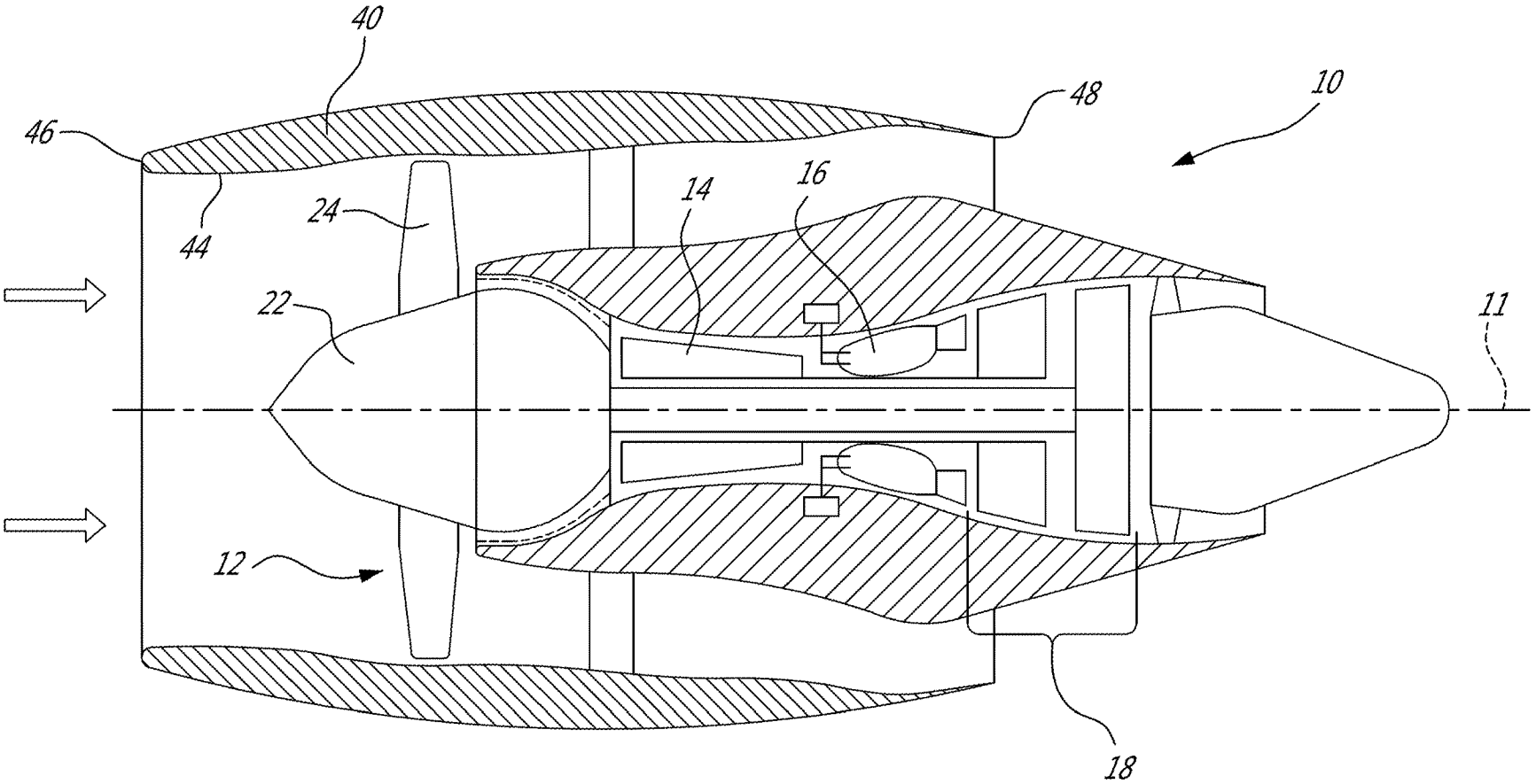
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. Engine 10 also comprises a nacelle 40 for containing various components of engine 10. Nacelle 40 has an annular interior surface 44, extending axially from an upstream end 46 (often referred to as the nose/inlet cowl) to a downstream end 48, for directing the ambient air (the direction of which is shown in double arrows in FIG. 1). Although the example below is described as applied to a fan of a turbofan engine, it will be understood the present teachings may be applied to any suitable gas turbine compressor rotor.

Figure 2:
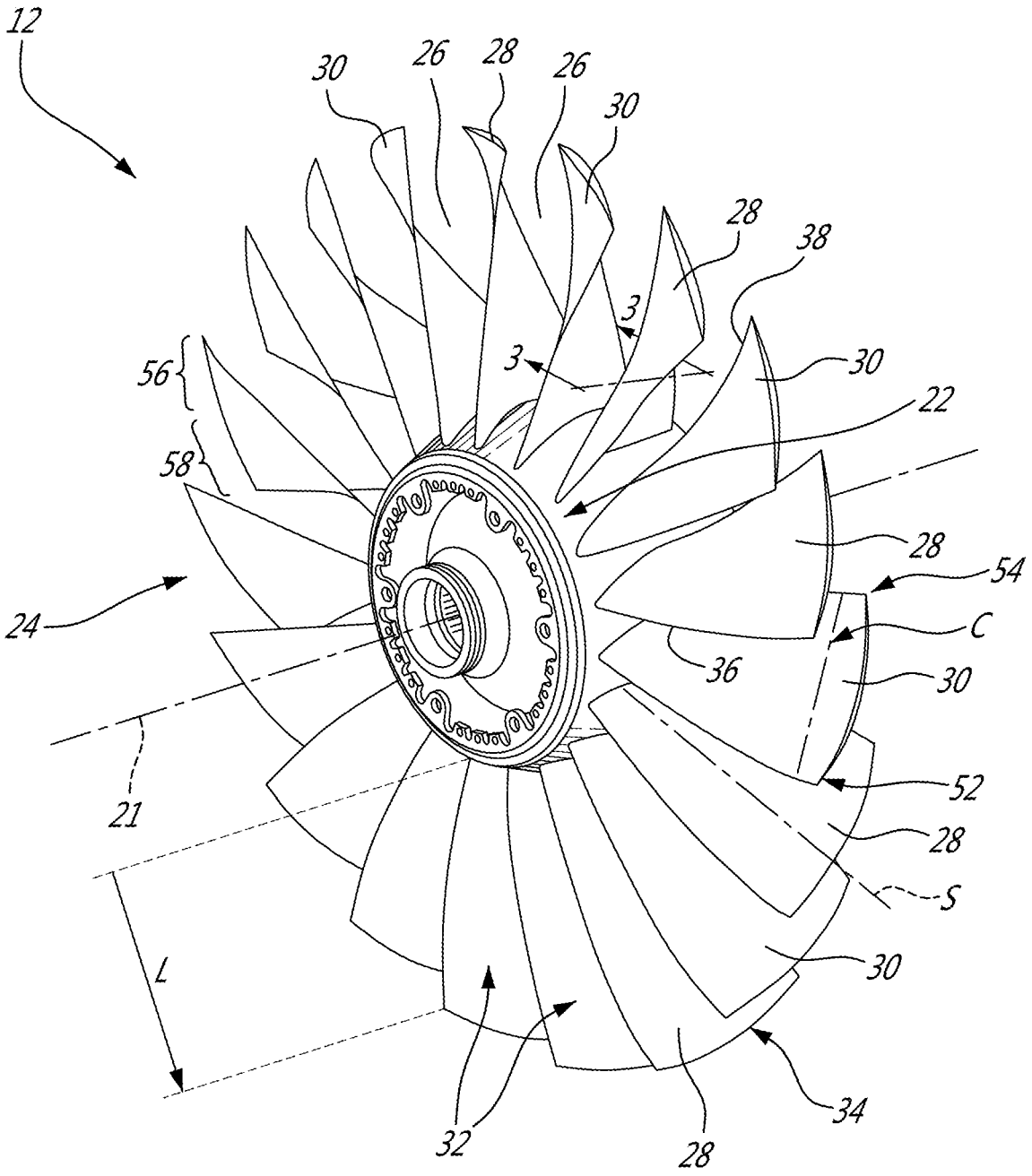
FIG. 2 is a schematic perspective view of a fan rotor of the gas turbine engine shown in FIG. 1.

As shown in more details in FIG. 2, the fan 12 includes a central hub 22, which in use rotates about an axis of rotation 21, and a circumferential row of fan blades 24 that are circumferentially distributed and which project a total span length L from hub 22 in a span-wise direction (which may be substantially radially) toward tips of the blades 24. The axis of rotation 21 of the fan 12 may be coaxial with the main engine axis, or rotational axis, 11 of the engine 10 as shown in FIG. 1. The fan 12 may be either a bladed rotor, wherein the fan blades 24 are separately formed and fixed in place on the hub 22, or the fan 12 may be an integrally bladed rotor (IBR), wherein the fan blades 24 are integrally formed with the hub 22. In a particular embodiment, the blades 24 are welded on the hub 22. Each circumferentially adjacent pair of fan blades 24 defines an inter-blade passage 26 therebetween for the working fluid.

The circumferential row of fan blades 24 of fan 12 includes two or more different types of fan blades 24, in the sense that a plurality of sets of blades are provided, each set having airfoils with non-trivially different properties, including but not limited to aerodynamic properties, shapes, which difference will be described in more details below and illustrated in a further figure. Flow-induced resonance refers to a situation where, during operation, adjacent vibrating blades transfer energy back and forth through the air medium, which energy continually maintains and/or strengthens the blades' natural vibration mode. Fan blades 24 have a number of oscillation patterns, any of which, if it gets excited and goes into resonance, can result in flow induced resonance issues.

The two or more different types of fan blades 24 are composed, in this example, of successively circumferentially alternating sets of fan blades, each set including at least first and second fan blades 28 and 30 (the first and second blades 28 and 30 having profiles which are different from one another, as will be described and shown in further details below). It is to be understood, however, that fan blades 24 may include more than two different blade types, and need not comprise pairs, or even numbers, of blade types. For example, each set of fan blades may include three or more fan blades which differ from each other (e.g. a circumferential distribution of the fan blades may include, in circumferentially successive order, blade types: A, B, C, A, B, C; or A, B, C, D, A, B, C, D, etc., wherein each of the capitalized letters represent different types of blades as described above).

The different characteristics of the first and second fan blades 28 and 30 provide a natural vibrational frequency separation between the adjacent first and second blades 28 and 30, which may be sufficient to reduce or impede unwanted resonance between the blades 24. Regardless of the exact amount of frequency separation, the first and second fan blades 28 and 30 are therefore said to be intentionally "mistuned" relative to each other, in order to reduce the occurrence and/or delay the onset, of flow-induced resonance. It is understood that although the fan rotor 12 comprises circumferentially alternating first and second blades 28 and 30, the fan rotor 12 may comprise only one second blade 30 sandwiched between the first blades 28.

Such a mistuning may be obtained by varying characteristics of the blades 24. These characteristics may be, for instance, the mass, the elastic modulus, the constituent material(s), etc. The differences between the first and second blades 28 and 30 may result in the first blades 28 being structurally stronger than the second blades 30 or vice-versa.

Still referring to FIG. 2, the blades 24 include airfoils 32 extending substantially radially from the hub 22 toward tips 34 of the blades 24 along span-wise axes S. The airfoils 32 have leading edges 36 and trailing edges 38 axially spaced apart from one another along chord-wise axes C. In a particular embodiment, the first blades 28 are stronger than the second blades 30 because a thickness distribution of the first blades 28 is different than a thickness distribution of the second blades 30. The thickness distribution is defined as a variation of a thickness of the blades 24 in function of a position along their chord-wise C and span-wise S axes. In a particular embodiment, the difference in thickness distributions causes a drag coefficient of the first blades 28 to be superior to a drag coefficient of the second blades 30. Hence, the first blades 28 are aerodynamically less efficient than the second blades 30.

Figure 3:
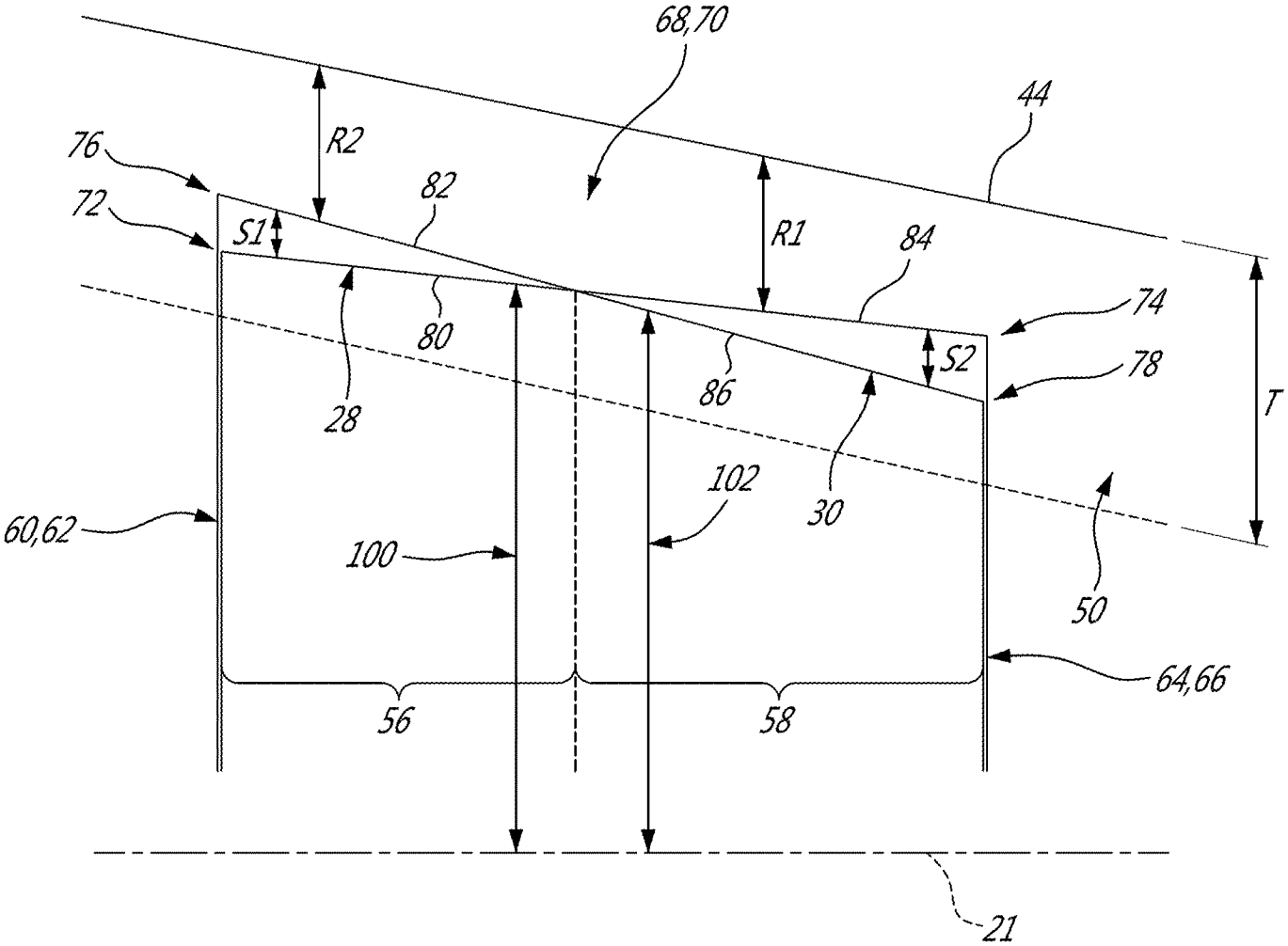
FIG. 3 is a schematic view along line 3-3 of the fan rotor of FIG. 2.

Referring to FIGS. 2 and 3, the fan rotor 12 is configured for rotation within the casing, or nacelle 44. The blade tips 34 are radially spaced apart from the nacelle annular interior surface 44 by radial tip clearances. Efficiency of the gas turbine engine 10 may be affected by tip leakage flow corresponding to a portion of the incoming flow (FIG. 1) that passes axially from an upstream side of the fan 12 to a downstream side thereof via the radial tip clearances instead of via the inter-blade passages 26. Hence, this portion of the incoming flow does not contribute to engine thrust and only contributes to drag. In the illustrated embodiment, a layer of abradable material 50 is disposed adjacent the nacelle interior surface 44. The blade tips 34 are able to abrade away portions of the layer 50 when a contact is created therebetween without damaging the blades 24. Portions of the blade tips 34 contact the layer 50 of abradable material only when the rotor 12 is in rotation about its rotational axis 21.

In some circumstances, the contact, or interaction, between the layer 50 and the blade tips 34, or portions thereof, may induce undesired resonance of the blades 24. When the blades 24 include the first and second blades 28 and 30, said blades may react differently upon contacting the layer 50 of abradable material. In the embodiment shown, the first and second blades 28 and 30 resonate when different portions of their respective tips rub against the layer 50. For instance, the first blades 28 may resonate when a rearward region of their tips is rubbing against the layer 50 whereas the second blades 30 may resonate when a forward region of their tips is rubbing against said layer. Stated otherwise, different portions of the blade tips 34 may be more or less sensitive to resonance when rubbing against the layer 50.

Therefore, it may be possible to remove portions of the layer 50 using one of the first blades 28 such that it protects the second blades 30 against interaction with the layer. For instance, a rearward portion of the first blades 28 may be used to abrade away the layer 50 of abradable material such that it eliminates, or reduces, rubbing between the rearward portion of the second blades 30 and said layer 50. Similarly, a forward portion of the second blades 30 may be used to abrade away the layer 50 to avoid or reduce rubbing between the forward portion of the first blades 28 and the layer 50. Other configurations are contemplated As mentioned above, the first and second blades 28 and 30 may differ in their natural vibration frequencies. Hence, the first and second blades 28 and 30 may deflect differently when the rotor 12 is in operation (i.e. when rotating). In a particular embodiment, the radial tip clearances of all the blades 24 is the same when the rotor 12 is not rotating and the differences in radial tip clearances appear when the rotor 12 is rotating. In another particular embodiment, the first and second blades 28 and 30 do not have the same radial tip clearances when the rotor 12 is stationary (i.e. not rotating). This may be obtained by machining the first and second blades 28 and 30 with different tip profiles. In a particular embodiment, the differences in radial tip clearances that are present when the rotor 12 is not rotating are enhanced when the rotor is rotating. In a particular embodiment, the first and second blades 28 and 30 only differ from one another by their radial tip clearance. This difference in radial tip clearances may impart a difference in the natural vibration frequencies of the first blades 28 compared to the second blades 30.

Referring more particularly to FIG. 3, the tip profiles of the first and second blades 28 and 30 projected on a common plane when the rotor 12 is in rotation are illustrated. As aforementioned, the different tip profiles may be the result of the mistuning of the first blades 28 relative to the second blades 30, of a difference in the manufacturing of the first and second blades, or both. As shown, in rotation, a radial distance between the nacelle 4 and the blade tips 34, also referred to as blade tip clearance, decrease below a value of a thickness T of the layer 50 of abradable material.

The blade tips 34 extend axially relative to the axis of rotation 21 from tip leading edges 52 to tip trailing edges 54 (FIG. 2). The tip leading and trailing edges 52 and 54 correspond to the intersection between the blade tips 34 and the airfoil leading edges 36 and between the blade tips 34 and the airfoil trailing edges 38, respectively.

In the embodiment shown, each of the blade tips 34 has first and second portions 56 and 58. The blade tip first portions 56 extend rearwardly (i.e. downstream, relative to the air flow through the rotor 12) from the tip leading edges 52, whereas the blade tip second portions 58 extend forwardly (i.e. upstream, relative to the air flow through the rotor 12) from the tip trailing edges 54. In the embodiment shown, the first and second portions 56 and 58 meet between the tip leading and trailing edges 36 and 38. It is however understood that the blade tips 34 may have more than two portions, and therefore that the first and second tip portions 56 and 58 may not directly abut or meet each other, but rather may have one or more additional portions axially therebetween. The first and second blades 28 and 30 have leading edges 60 and 62, trailing edges 64 and 66, and tips 68 and 70, respectively. The first blade tips 68 extend from first blade tip leading edges 72 to first blade tip trailing edges 74. The second blade tips 70 extend from second blade tip leading edges 76 to second blade tip trailing edges 78. The first and second blade tips 68 and 70 each have first portions 80 and 82 and second portions 84 and 86, respectively.

Still referring to FIG. 3, radial tip clearances R1 and R2 of the first and second blade tips 68 and 70 vary between their tip leading edges 72 and 76 and their tip trailing edges 74 and 78. In the embodiment shown, a mean radial tip clearance—which is defined as an average value of the radial tip clearance along a given portion—of the first blade first portions 80 is superior to a mean radial tip clearance of the second blade first portions 82 and a mean radial tip clearance of the first blade second portions 84 is inferior to a mean radial tip clearance of the second blade second portions 86. Stated otherwise, in the blade first portions 56, the tips 70 of the second blades 30 extend radially beyond the tips 68 of the first blades 28. And, in the blade second portions 58, the tips 68 of the first blades 28 extend radially beyond the tips 70 of the second blades 30. Therefore, in operation, the first blade first portions 80 and the second blade second portions 86 are not rubbing against the layer of abradable material 50 because it is abraded away by the second blade first portions 82 and by the first blade second portions 84, respectively.

In the embodiment shown, the radial tip clearances R1 and R2 of the first and second blade tips 68 and 70 vary continuously from their respective tip leading edges 72 and 76 to their respective tip trailing edges 74 and 78 at given rates. In one particular embodiment, a given rate of change of the radial tip clearances R1 of the first blade tips 68 is from +0.004 in/in to +0.006 in/in and a given rate of change of the radial tip clearances R2 of the second blade tips 70 is from −0.001 in/in to −0.004 in/in. In the embodiment shown, the radial tip clearance R1 of the first blade tips 68 decreases toward their tip trailing edges 74 whereas the radial tip clearance R2 of the second blade tips 70 increases toward their tip trailing edges 78. Other configurations are contemplated. For example, in a particular embodiment, the radial tip clearances of both the first and second blade tips increases or decreases toward their respective tip trailing edges 74 and 78 but at different rates. In one particular embodiment, a ratio of a maximum radial tip clearance difference between the radial tip clearances of the first and second blade tips 68 and 70 over a diameter of the fan rotor 12 is from 0.001 to 0.0001.

Still referring to FIGS. 2-3, the blade tips 68 and 70 are spaced apart from the axis of rotation 21 by spans 100 and 102. In the embodiment shown, a mean span of the first tip portion 80 of the first blades 28 is less than a mean span of the first tip portion 82 of the second blades. A mean span of the second tip portion 84 of the first blades 28 is greater than a mean span of the second tip portion 86 of the second blades 30.

Referring to FIGS. 1-3, during operation of the engine, when the rotor 12 is rotating within a casing or nacelle 40, the blades 24 of the rotor 12 rotate about the rotational axis 21. A radial spacing S1 between the first tip portion 80 of one of the first blades 28 and the layer 50 of abradable material is created by removing a portion of the layer of abradable material with a first tip portion 82 of one of the second blades 30. A radial spacing S2 between a second tip portion 86 of one of the second blades 30 and the layer 50 is created by removing a portion of the layer of abradable material with a second tip portion 84 of the one of the first blades 28.

In the illustrated embodiment, the first and second blades 28 and 30 are provided around the hub 22 and a mean radial tip clearance of the first tip portions 80 of the first blades 28 is superior to a mean radial tip clearance of the first tip portions 82 of the second blades 30. And, a mean radial tip clearance of the second tip portions 84 of the first blades 28 is inferior to a mean radial tip clearance of the second tip portions 86 of the second blades 30. In a particular embodiment, the first and second blades 28 and 30 are provided with different natural vibration frequencies such that the first blades 28 deflect differently than the second blades 30 when the rotor 12 is in rotation. In a particular embodiment, rotating the blades 24 around the rotational axis 21 causes the first blades 28 to axially deflect relative to the second blades 30.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A rotor for a gas turbine engine, the rotor adapted to be received within a casing having a radially inner surface and configured for rotation about a rotational axis, the rotor comprising a hub and blades circumferentially distributed around the hub, the blades extending radially along spans from the hub to tips thereof and including at least first blades and second blades, the blades having airfoils with leading edges and trailing edges, the tips of the blades extending axially relative to the rotational axis of the rotor from tip leading edges to tip trailing edges, the tips of each of the blades having at least first and second tip portions extending axially between the tip leading edges and the tip trailing edges; wherein a mean span of the first tip portion of the first blades is less than a mean span of the corresponding first tip portion of the second blades, and a mean span of the second tip portion of the first blades is greater than a mean span of the corresponding second tip portion of the second blades.

2. The rotor of claim 1, wherein the spans vary from the tip leading edges to the tip trailing edges.

3. The rotor of claim 1, wherein the span of the first blades increases from the tip leading edge to the tip trailing edge thereof, and the span of the second blades decreases from the tip leading edge to the tip trailing edge thereof.

4. The rotor of claim 1, wherein each of the first blades is disposed circumferentially between two of the second blades, the first blades having a natural vibration frequency different than a natural vibration frequency of the second blades.

5. The rotor of claim 1, wherein the first tip portions extend downstream from the tip leading edges and the second tip portions extend upstream from the tip trailing edges.

6. The rotor of claim 1, wherein a ratio of a maximum span difference between spans of the first blades and of the second blades over a mean diameter of the rotor is from 0.0001 to 0.001.

7. The rotor of claim 1, wherein the first blades have a natural vibration frequency different than a natural vibration frequency of the second blades.

8. The rotor of claim 1, wherein the first and second tip portions meet between the tip leading and trailing edges.

9. A gas turbine engine comprising: a rotor having a hub and a plurality of blades circumferentially distributed around the hub, the blades extending radially from the hub to tips of the blades, the blades having airfoils with leading edges and trailing edges, the tips of the blades extending axially relative to a rotational axis of the rotor from tip leading edges to tip trailing edges, the tips of the blades having at least first and second tip portions extending between the tip leading edges and the tip trailing edges; and a casing disposed around the rotor, a radially-inner surface of the casing spaced from the tips of the blades by radial tip clearances; wherein a mean radial tip clearance of a first tip portion of one of the blades is greater than a mean radial tip clearance of a first tip portion of another one of the blades, and a mean radial tip clearance of a second tip portion the one of the blades is less than a mean radial tip clearance of a second tip portion of the other one of the blades.

10. The gas turbine engine of claim 9, wherein radial tip clearances of the blade tips vary from the tip leading edges to the tip trailing edges.

11. The gas turbine engine of claim 9, wherein a radial tip clearance of the one of the blades decreases from a tip leading edge to a tip trailing edge thereof and a radial tip clearance of the other one of the blades increases from a tip leading edge to a tip trailing edge thereof.

12. The gas turbine engine of claim 9, wherein the blades include first blades and second blades, each of the first blades disposed circumferentially between two of the second blades, the first blades having a natural vibration frequency different than a natural vibration frequency of the second blades, the one of the blades being one of the first blades, the other one of the blades being one of the second blades.

13. The gas turbine engine of claim 9, wherein the first tip portions extend downstream from the tip leading edges and the second tip portions extend upstream from the tip trailing edges.

14. The gas turbine engine of claim 9, wherein a ratio of a maximum radial tip clearance difference between radial tip clearances of the one of the blades and of the other one of the blades over a diameter of the rotor is from 0.001 to 0.0001.

15. The gas turbine engine of claim 9, wherein the one of the blades has a natural vibration frequency different than a natural vibration frequency of the other one of the blades.

16. The gas turbine engine of claim 9, wherein the first and second tip portions meet between the tip leading and trailing edges.

17. A method of forming a rotor within a casing of a gas turbine engine, the method comprising:

providing the rotor with a hub and a plurality of blades circumferentially distributed around the hub, the blades extending radially from the hub to tips of the blades and including at least first and second blades, the tips of the blades adapted to be circumscribed by the casing;

forming a first radial tip clearance gap between a first tip portion of the first blades and a layer of abradable material on an inner surface of the casing; and forming a second radial tip clearance gap between a second tip portion of the second blades and the layer of abradable material, the first and second radial tip clearance gaps being different.

18. The method of claim 17, wherein a mean radial tip clearance of first tip portions of the first blades is greater than a mean radial tip clearance of first tip portions of the second blades, and a mean radial tip clearance of second tip portions of the first blades is less than a mean radial tip clearance of second tip portions of the second blades.

19. The method of claim 17, wherein the first blades have a natural vibration frequency different than a natural vibration frequency of the second blades.

20. The method of claim 17, wherein, during operation, the first blades axially deflect relative to the second blades.

* * * * *